US005669301A

United States Patent [19]

Bachmann et al.

[11] Patent Number: 5,669,301

[45] Date of Patent: Sep. 23, 1997

[54] PROCESS AND DEVICE FOR ROTATING AN INK CONTAINER USED IN TAMPON PRINTING

[75] Inventors: Louis Bachmann, Wil; Fredi Studer, Frauenfeld, both of Switzerland

[73] Assignee: Teca-Print AG, Thayngen, Switzerland

[21] Appl. No.: 559,146

[22] Filed: Nov. 17, 1995

[30] Foreign Application Priority Data

Nov. 18, 1994 [CH] Switzerland ..... 3481/94

[51] Int. Cl.[6] ..... B41F 9/10

[52] U.S. Cl. ..... 101/163; 101/169

[58] Field of Search ..... 101/35, 41, 163, 101/167, 169; 118/429

[56] References Cited

U.S. PATENT DOCUMENTS

| | | | |
|---|---|---|---|
| 3,742,902 | 7/1973 | Heston, Jr. | 101/124 |
| 4,557,195 | 12/1985 | Phlipp | 101/167 |
| 5,003,872 | 4/1991 | Dalferth | 101/163 |
| 5,272,973 | 12/1993 | Chojnacki | 101/163 |
| 5,320,037 | 6/1994 | Harris | 101/163 |
| 5,419,247 | 5/1995 | Bachmann | 101/318 |

FOREIGN PATENT DOCUMENTS

| | | |
|---|---|---|
| 43 16 294 A1 | 11/1993 | Germany . |
| WO 93/11943 | 6/1993 | WIPO . |

*Primary Examiner*—Stephen R. Funk
*Attorney, Agent, or Firm*—McGlew & Tuttle

[57] ABSTRACT

A printing block is inked with a container containing printing ink, and printing formats or partial images are transferred to workpieces with a tampon. An edge of the container, which edge lies on the printing block, is rotated on the printing block around a vertical axis during a relative movement between the container and the printing block. As a result, the printing block can be used longer, and a clean print is guaranteed for a longer time in the case of abrasive printing inks.

10 Claims, 3 Drawing Sheets

PROCESS AND DEVICE FOR ROTATING AN INK CONTAINER USED IN TAMPON PRINTING

FIELD OF THE INVENTION

The present invention pertains to a process for tampon printing, in which a printing block is inked with a container accommodating a liquid medium and printing formats or partial images are tansferred to a workpiece with a tampon. The present invention also pertains to a device for tampon printing, with which a container, which is open at least on one side, and which has on its open side an edge that lies on a printing block, wherein the printing block and the container perform a relative movement in relation to one another to ink the printing block.

BACKGROUND OF THE INVENTION

A process and a device of this type have been known from, e.g., WO 93/11943. In this device, the depressions in the surface of the printing block are filled by the medium present in the container during the relative movement between the container and the printing block, and excess medium is at the same time wiped off with the edge of the container. The edge of the container is pressed onto the top side of the printing block by means of a pressing means. This device has also proved successful per se in practice, and it makes it possible to prepare clean prints on different workpieces at a high output.

A process has also been known, in which a hollow profile section corresponding to the container is rotated by a predetermined angle range after each inking process. A uniform supply of more ink from the hollow profile section is to be achieved by this rotation. Such nonuniform resupply may occur when the ink in the hollow profile section is greatly inclined, and it covers only part of the base surface of the hollow profile section, especially at a low degree of filling, as a consequence of the relative movement between the printing block and the hollow profile section during the inking and the wiping off of the surface of the ink. According to this process, the hollow profile section is rotated for more rapid leveling of the ink, which is to be achieved in the tampon printing machine according to DE-A-43 16 294 by means of a perforated disk inserted into the container.

To rotate the hollow profile section, the hollow profile section is coupled with a drive means on its circumference. This drive means is fictionally coupled with the hollow profile section, and it is in detachable connection with same.

However, it was found that certain media, especially abrasive media, lead to an unclean print with such a device after a short printing time, which can be attributed to stress marks on the printing block.

SUMMARY AND OBJECT OF THE INVENTION

The primary object of the present invention is to improve a process and a device of the above-described type such that a clean and satisfactory print is guaranteed even in the case of the above-mentioned problematic media, even after a prolonged operating time.

This object is accomplished in a process of this type by at least one end of the container lying on the printing block being rotated essentially in its circumferential direction on the printing block during a relative movement between the container and the printing block. Consequently, not only is a relative movement between the container and the printing block carried out in the process according to the present invention, but the edge of the container is also rotated at the same time essentially in its circumferential direction. Hardly any stress marks are detectable on the printing block even after a prolonged operating time, which might be due to the edge moving in the circumferential direction on the printing block cutting off, as it were, the printing ink. In addition, it was surprisingly found that not only do previously problematic media yield a clean print, but the contact pressure of the container on the surface of the printing block can also be reduced at the same time, which is an essential advantage in terms of the correspondingly reduced wear of the edge of the doctor blade and of the printing block. Finally, it was also surprisingly found that the solvent consumption is lower at equal print output.

The edge is preferably rotated in one circumferential direction only. The rotation may take place continuously or at intervals. The rotation in the circumferential direction may be smaller than 360° and/or alternating, so that the pot can be connected to a reservoir for printing ink for diluting liquid via flexible lines.

The device according to the present invention is characterized in that the container is connected to a drive, with which at least the edge of the container is rotatable in its circumferential direction during the said relative movement with an essentially constant contact pressure, and the drive forms one unit with a pressing means, and this unit acts on the container approximately centrally, on the top side of the container. An especially simple operation is possible as a result, because the circumference of the container is freely accessible. In addition, lateral transverse forces acting on the container are avoided.

Preferably the entire container is rotated in the container's circumferential direction. The edge of the container is preferably alternatingly rotated in one circumferential direction or the other. The edge may be rotated around its center. The edge is preferably rotated by less than 360 degrees.

The preferred embodiment provides that the container is rotated approximately centrally on its top side and is pressed downward. The pressing means preferably has a vertically movable rod which is connected to the container at its lower end into a rotating drive at its top end. The drive preferably exerts a back and forward movement on the edge of the container. The drive preferably includes means for rotating the container in one direction or in the other.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
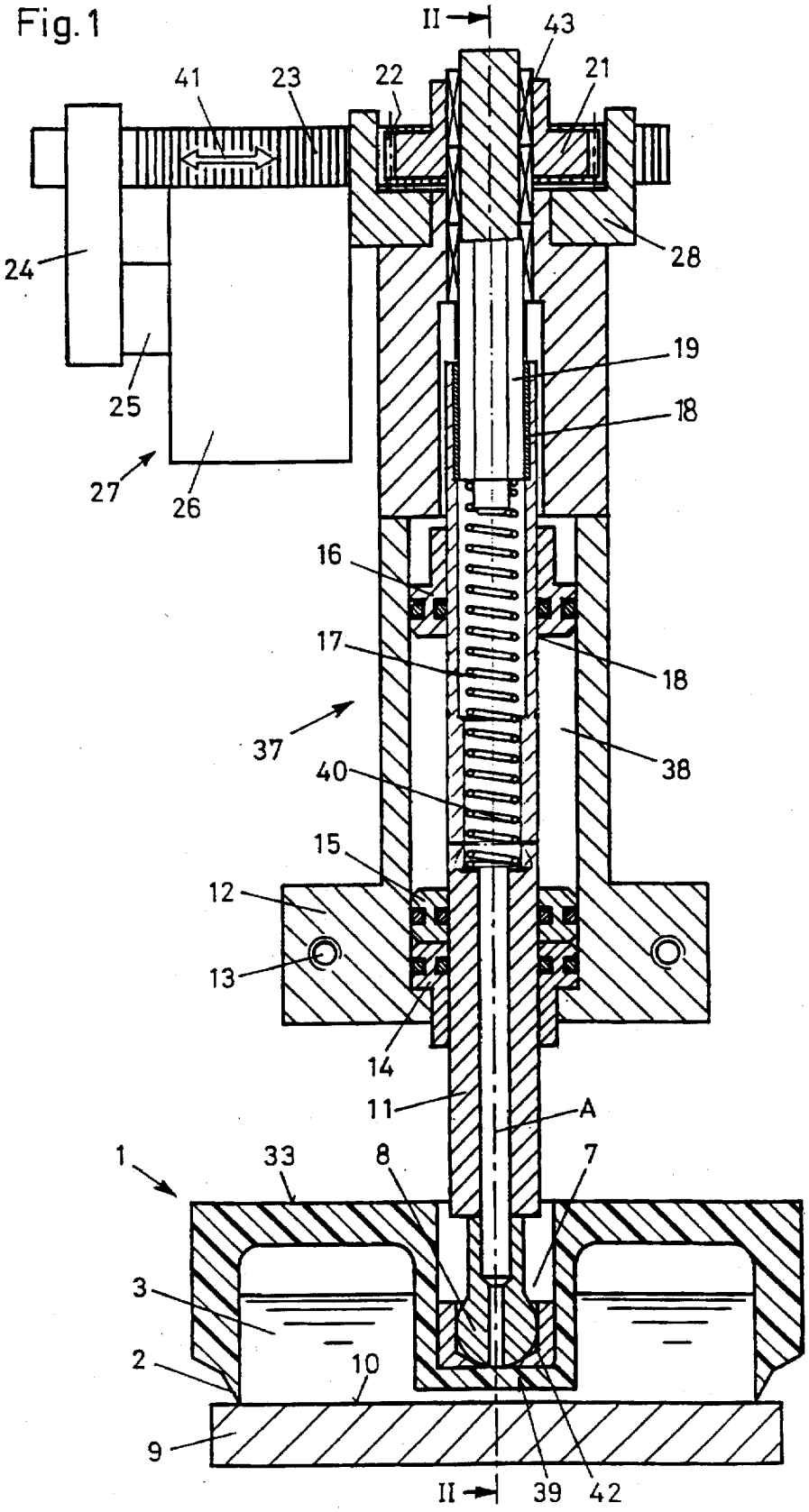
FIG. 1 is a schematic and partially sectional representation of a device according to the present invention.
Figure 4:
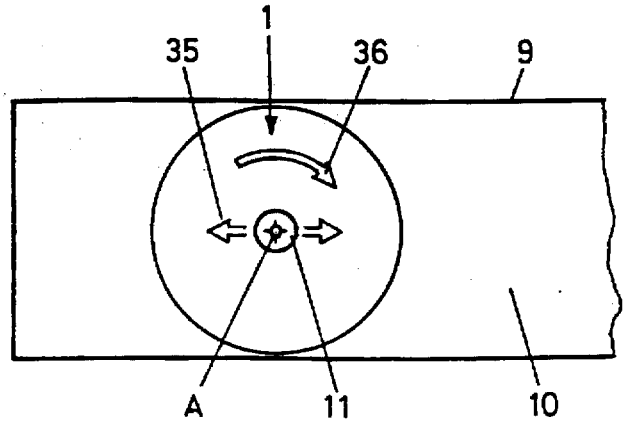
FIG. 4 is a schematic partial view of a printing block with a container to illustrate the movements performed during the inking or the wiping off.

FIG. 1 shows a printing block 9 with an essentially flat top side 10, on which a container 1 lies. The printing block 9 is moved linearly to and fro in its plane according to the double arrow 35 in FIG. 4 with a drive, not shown. The medium 3 located in the container 1 is applied to the top side 10 of the printing block 9 and is wiped off with a doctor blade-like edge 2.

To prevent the container 1 from floating during the inking, the container 1 is pressed against the top side 10 of the printing block 9. To achieve this, a pressing means 37, which is a rigid part of the frame and is connected at a preferably articulated connection point 7 centrally to a top side 33 and to the container 1 under this top side, is provided.

The pressing means 37 has a flange part 12, which is provided with two threaded holes 13 for its fixation to a frame, not shown here. The flange part 12 forms a cylindrical housing with a pressure space 38, in which inserts 14 and 16, which are disposed at spaced locations from one another and accommodate a piston rod 11 displaceable to a limited extent in its longitudinal direction, are arranged. A hexagon head 8, which is detachably inserted into a corresponding recess 42 of a connection part 39, is arranged at the lower end of the piston rod 11. A blind hole 40, into which a compression spring 17 supported at its top end at a shoulder of a shaft 19 extends, is recessed into the top end of the piston rod 11. The rod 11, displaceably guided in the inserts 16 and 14, is pressed downward by pneumatic pressure and by means of the compression spring 17, and thus it presses the container 1 onto the top side 10 of the printing block 9 via the connection 7.

The piston rod 11 is rotatable by means of a drive 27 around its longitudinal axis A, which is preferably the axis of rotation of the container 1. The container 1 is inherently rotated in the same direction during such a rotation. The drive 27 has a toothed rack 23, which is movable in the directions of the double arrow 41 by means of a piston-and-cylinder unit 26. The toothed rack 23 engages teeth 22 of a gear 21 in a housing part 28. The gear 21 is nonrotatably connected in one direction to the shaft 19 by means of a free-wheel mechanism 43, and this shaft 19 is connected nonrotatably and longitudinally displaceably to the piston rod 11 via a coupling 18. The back and forward motions of the toothed rack 23 in the directions of the double arrow 41 are performed by corresponding movements of the piston 25, which is connected to the toothed rack 23 via a web 24. Corresponding to the back and forward motion of the toothed rack 23, the container 1 is rotated in the direction of arrow 36 around its axis of rotation A according to FIG. 4. However, an alternating rotation is also conceivable. The free-wheel mechanism 43 is now replaced by a connection which is nonrotatable in both directions.

Other drives, e.g., a pneumatic motor or electric motor, are also conceivable for rotating the rod 11. Finally, special gear mechanisms, e.g., a Geneva movement, which is driven by means of the linear relative movement between the pot and the printing block, are possible as well.

Figure 2:
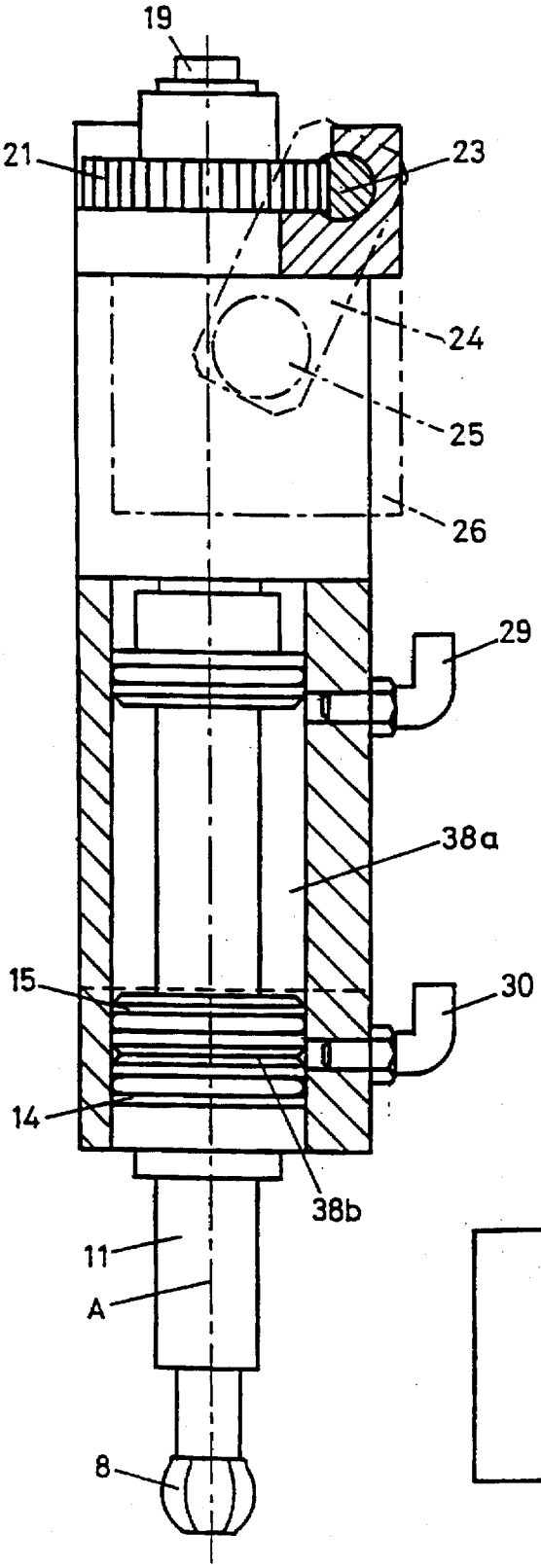
FIG. 2 is a sectional view along line II—II in FIG. 1, wherein the container and the printing block are omitted.
Figure 3:
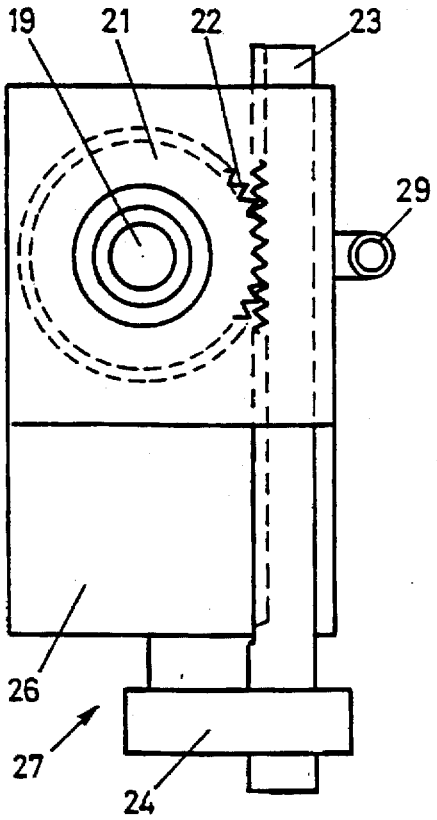
FIG. 3 is a top view of the device according to FIG. 2.

To clean or replace the container 1, the piston rod 11 can be pulled out of the container at right angles to the surface 10. To do so, a piston 15, which can be raised in the position according to FIGS. 1 and 2 by increasing the pressure in the inner space 38*a* via a connection 30 and displacing pressurized medium from a space 38*b* via the connection 29, is fastened to the rod 11. If the piston rod 11 with the head 8 has been raised, the container can be displaced on the printing block. When a cleaned container 1 is mounted, it is positioned, in the opposite order, on the printing block with the rod 11 raised, and it is again pressed onto the printing block 9 by means of the piston rod 11. The replacement and the cleaning of the container 1 can thus be performed simply, rapidly and cleanly.

A plurality of containers 1 arranged next to each other can be rotated by means of the toothed rack 23 if the latter is designed to be correspondingly long. Thus, a single drive 27 is sufficient for rotating a plurality of containers 1.

Figure 5:
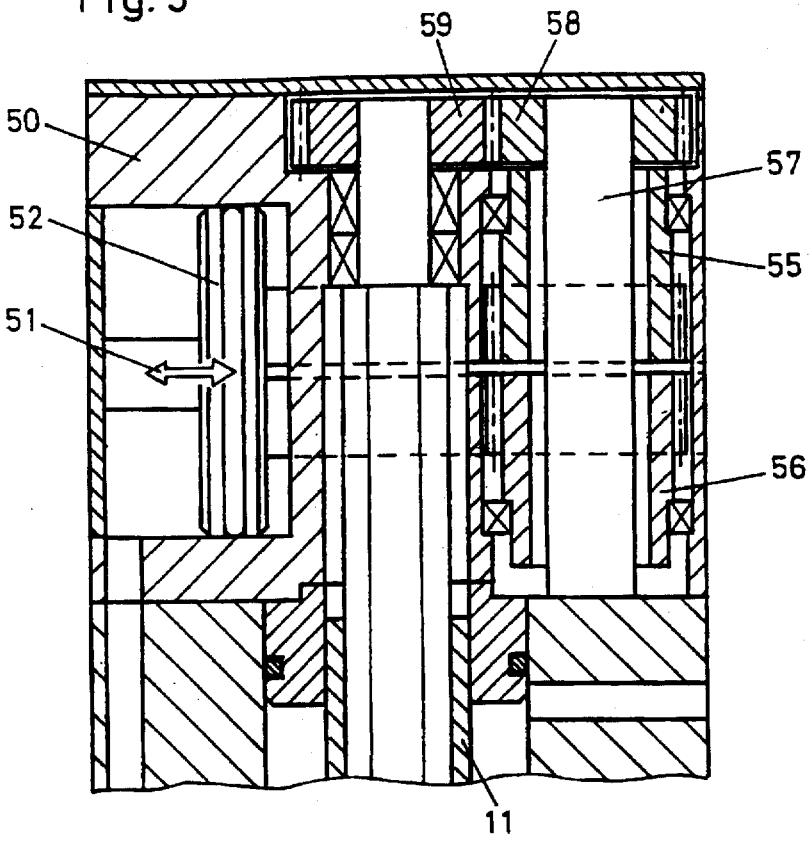
FIGS. 5 and 6 are sectional views through an alternative embodiment of a drive on a device according to FIGS. 1 through 4.
Figure 6:
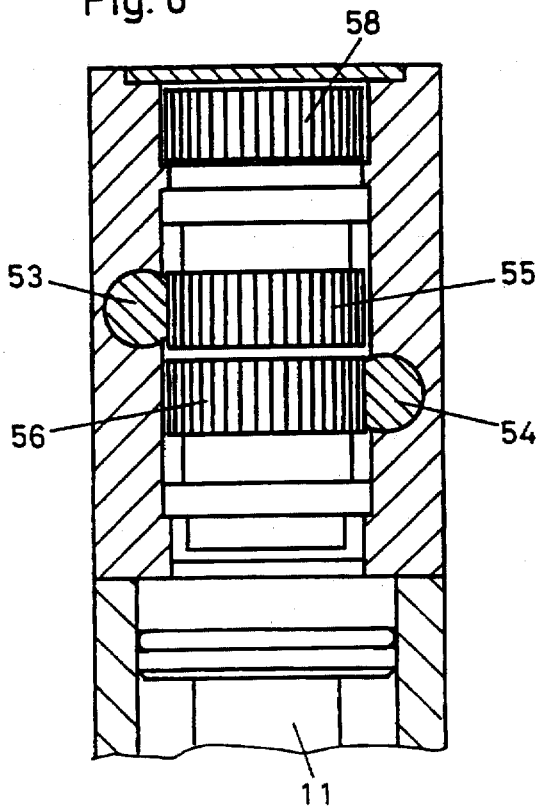

The design according to FIGS. 5 and 6 differs from the above-mentioned design in terms of the drive, which likewise has here a piston 52 hydraulically or pneumatically movable in the directions of the double arrow 51 in a housing 50. Two toothed racks 53 and 54, which engage an upper free-wheel mechanism 55 or a lower free-wheel mechanism 56, are connected to the piston 52. The two free-wheel mechanisms 55 and 56 lock in different directions of rotation, so that the rod 11 and thus the container 1, not shown, are rotated alternatingly in one direction or the other via a shaft 57 and two gears 58 and 59 during a back and forward motion of the piston 52.

Another design is also possible, in which alternating rotation is performed, but the rotation is performed over a larger angle or more rapidly in one direction of rotation than in the other direction of rotation.

In the embodiments shown, the rod 11 rotates the container 1 around a central axis. However, designs in which this axis is offset laterally are also conceivable. However, the container 1 is always rotated around an axis extending at right angles to the printing block in addition to the translatory relative movement in relation to the printing block.

While specific embodiments of the invention have been shown and described in detail to illustrate the application of the principles of the invention, it will be understood that the invention may be embodied otherwise without departing from such principles.

What is claimed is:

1. A process for tampon printing, comprising the steps of: inking a printing block with a container, the container accommodating a liquid printing medium; transferring printing formats or partial images from the printing block to a work piece with a tampon; rotating an edge of the container, which edge lies on the printing block, around a vertical axis during a relative movement between the container and the printing block.

2. A process according to claim 1, wherein the entire container is rotated in a circumferential direction.

3. A process according to claim 1, wherein said edge is alternatingly rotated in one circumferential direction or the other.

4. A process according to claim 1, wherein said edge is rotated around its center.

5. A process according to claim 1, wherein said edge is rotated by less than 360°.

6. A device for tampon printing, comprising a container with at least one open side, said open side having an edge; a printing block, said edge of said container lying on said printing block, said printing block and said container performing relative movement in relation to one another to ink said printing block; a drive connected to said container for rotating said edge of said container around a vertical axis during said relative movement; and a pressing means for pressing said container against said printing block, said drive and said pressing means forming a single unit, said unit acting on said container approximately centrally, on a top side of said container.

7. A device according to claim 6, wherein said container is rotated approximately centrally on said top side and is pressed downwardly by said pressing means.

8. A device according to claim 6, wherein said pressing means includes a vertically movable rod which is connected to said container at a lower end, said movable rod being connected to said drive at a top end.

9. A device according to claim 6, wherein said drive rotates said edge in a backward and forward movement.

10. A device according to claim 6, wherein said drive includes means for rotating said container in one direction or for rotating said container in the other direction.

* * * * *